US005301624A

United States Patent [19]

Hall et al.

[11] Patent Number: 5,301,624

[45] Date of Patent: Apr. 12, 1994

[54] STERN PLANES FOR SWATH VESSEL

[75] Inventors: Nelson W. Hall, Poway, Calif.; Donald T. Higdon, Flagler Beach, Fla.

[73] Assignee: Swath Ocean Systems, Inc., Chula Vista, Calif.

[21] Appl. No.: 21,449

[22] Filed: Feb. 24, 1993

[51] Int. Cl.[5] ..... B63B 1/10

[52] U.S. Cl. ..... 114/61; 114/274; 440/66

[58] Field of Search ..... 440/66, 67, 68; 114/61, 114/123, 274, 278

[56] References Cited

U.S. PATENT DOCUMENTS 2,415,183 7/1947 Law ..... 440/66
3,977,348 8/1976 Bordat et al. ..... 114/280
4,174,671 11/1979 Seidl ..... 114/61
4,781,632 11/1988 Litjens et al. ..... 440/66
4,919,063 4/1990 Hall et al. ..... 114/61
5,134,954 8/1992 Barry et al. ..... 440/66

FOREIGN PATENT DOCUMENTS 1170011 1/1959 France ..... 440/66

*Primary Examiner*—David M. Mitchell
*Assistant Examiner*—Stephen P. Avila
*Attorney, Agent, or Firm*—Charles E. Townsend, Jr.; Edward J. Keeling

[57] ABSTRACT

The invention provides an improved SWATH type vessel having pontoons and a stern plane located in a position to influence water flow in the region of the tail cone portions of the pontoons and the propellers to reduce depression of the water adjacent the propellers which would otherwise cause propeller ventilation when the vessel is moving at speed.

17 Claims, 7 Drawing Sheets

STERN PLANES FOR SWATH VESSEL

BACKGROUND OF THE INVENTION

This invention relates to a new and improved SWATH type vessel and more particularly to the use of stern planes in the aft portion of such a vessel to improve the performance thereof.

DESCRIPTION OF THE PRIOR ART

The term "SWATH" is an acronym for Small Waterplane Area Twin Hull. Conceptually, SWATH vessels date back at least 50 years. A SWATH vessel generally includes two submerged, parallel, torpedo-like pontoons, each of which is provided with one or more vertical struts which project upwardly a substantial distance above the water line and which at their upper ends support the above-water superstructure of the vessel. As used herein, the superstructure of the vessel includes all parts of the vessel above the wet-deck, and it includes the portion of the vessel between the wet deck and the weather-deck. The combined buoyancy of the two (or more) pontoons and the immersed portion of the vertical struts is sufficient to support the superstructure of the vessel a predetermined distance (e.g. 5-8 feet) above the water level while the boat is at rest, as well as when it is under way in relatively calm waters. It is well known to provide SWATH vessels with underwater horizontal stabilizers or canards to assist in maintaining stability of the boat in terms of pitch and roll while moving at medium to higher speeds through calm or rough waters.

The above-water superstructure of a SWATH may be designed and outfitted to function substantially the same as a conventional mono-hull boat or ship. That is it may be fitted as either primarily a cargo vessel or a passenger-carrying vessel. During more recent years, a number of SWATH vessels, ranging in length from approximately 60 feet to over 200 feet, have been built and tested or operated as ocean or seagoing vessels with reasonable success.

As noted in U.S. Pat. No. 4,919,063 which is assigned to the assignee of the present invention, all of the reasonably well designed SWATH vessels that have been built and operated within the past decade provide much enhanced riding stability over any known conventional hull or catamaran construction. A properly designed SWATH inherently provides a much more "level" ride as far as minimizing the amount of pitch and roll inherent in more conventional designs.

The SWATH vessel generally includes two laterally separated, parallel, streamlined, underwater pontoons, each connected to a superstructure located above the water surface by one or more slender, surface piercing struts. The primary purpose of this hull form is to provide smaller motions in a seaway than can be obtained by other hull forms, over a wide range of speeds. The vessel is supported by the buoyancy of the submerged pontoons and, to a lesser extent, the submerged portion of the strut, both at rest and under way. The design water line is located on the struts part way between the tops of the pontoons and the bottom of the upper platform. Adequate hydrostatic stability is obtained by selection of the amount of separation between the struts on either side of the vessel and the length and thickness of the struts at the water line. Usually, a propeller is located at the aft end of each pontoon behind a streamlined tail cone, and a rudder, attached to the overhanging strut, is located behind each propeller. In order to maintain stability at high speed, at least two approximately horizontal hydrofoil fins are added as far aft on the pontoons as is practical. Sometimes a single hydrofoil spanning the space between the pontoons is used. These fins, called stabilizer fins, are often actively controlled, along with additional forward hydrofoil fins, called canard fins, to reduce motions caused by ocean waves.

Some problems however have been encountered in practical application of SWATH vessels. Thus, practical limits are imposed on the depth of the pontoons below the surface by the water depths in the harbors. Often, these draft limits cause the pontoons of the SWATH vessel to be sufficiently near to the water surface that when running at moderate to high speeds at level trim, reduced pressure occurs on the upper side of the pontoon tail cone and a depression is formed in the water surface above the propeller. The reduced pressure on the tail cone increases drag on the vessel and the water surface depression can cause the propeller to ventilate (ingest air), resulting in vibration and loss of propeller efficiency. In order to improve performance under these conditions, the vessel is usually trimmed down by the stern, utilizing the stabilized fins, usually two or three degrees to alter the flow pattern at the tail cone and move the propeller further below the water surface. Trimming the stern down decreases the clearance between the water surface and the superstructure, increasing the possibility of "slamming" when heading into even moderate seas. Furthermore, the resulting slant of the deck caused by trimming down of the vessel can be undesirable for some SWATH vessel applications. Depression of the water surface over the propeller can also be produced by downward deflection of the trailing edge of the aft stabilizer fin, usually located not far ahead of the propeller. To avoid propeller ventilation from this source, deflection of the stabilizer fin is usually restricted, causing a corresponding loss in its control effectiveness. There is a need therefore for a practical means for solving this problem.

SUMMARY OF THE INVENTION

The invention provides a SWATH vessel including a superstructure and first and second pontoons disposed beneath the superstructure. The pontoons include a streamlined tail cone forming the aft portion of each of the pontoons. At least one strut is disposed between each pontoon and the superstructure for supporting the superstructure above the design water depth of the vessel. The combined buoyancy of the first and second pontoons and the struts is sufficient to support the superstructure spaced above the waterline by a prescribed distance when the vessel is in calm water. Propellers are located aft of each streamlined tail cone of each of the first and second pontoons. Engine means are disposed in the SWATH type vessel for driving the propellers using drive shafts operatively connected to the engine means. The drive shafts extend out of the aft portion of each of the streamlined tail cones of each of the pontoons and are connected to each propeller.

A horizontally disposed stern plane is connected to each strut or pontoon as desired immediately above each propeller and the streamline tail cone of each of the pontoons. The stern plane is located below the designed waterline of the SWATH type vessel. Each of the stern planes is configured and located with respect to each propeller and each streamlined cone to influence water flow over the upper side of each of the streamlined tail cones to substantially reduce the tendency toward water flow which otherwise would cause propeller ventilation when the SWATH type vessel is moving. In some configurations it may be desirable to include a movable controllable flap at the trailing end of the stern planes to provide for additional control of the vessel.

The stern plane is disposed at a preselected position with relation to the tail cone and the propeller. Preferably the stern plane is connected to the strut connecting the superstructure with the pontoon. The stern plane should overlie about the aft ⅓ to ⅔ of the tail cone of the pontoon and preferably should overlie the aft 50% of the tail cone and should extend closely over the propeller. Preferably the location and length of the stern plane is such so as to induce water flow which might otherwise flow along the streamlined tail cone when the vessel is at speed, to rather flow over the stern plane thus promoting water flow from below to fill the space around the upper portion of the propeller to thus reduce ventilation of the propeller.

OBJECT OF THE INVENTION

A principal object of the present invention is to provide an improved SWATH type vessel by using a stern plane to overcome the tendency of propeller ventilation by redirecting the water flow over the aft portion of the vessel's pontoons and the propellers. Additional objects and advantages of the present invention will become apparent from the following detailed description read in view of the accompanying drawings which are incorporated herein and made a part of this specification.

DETAILED DESCRIPTION OF THE INVENTION

Figure 1:
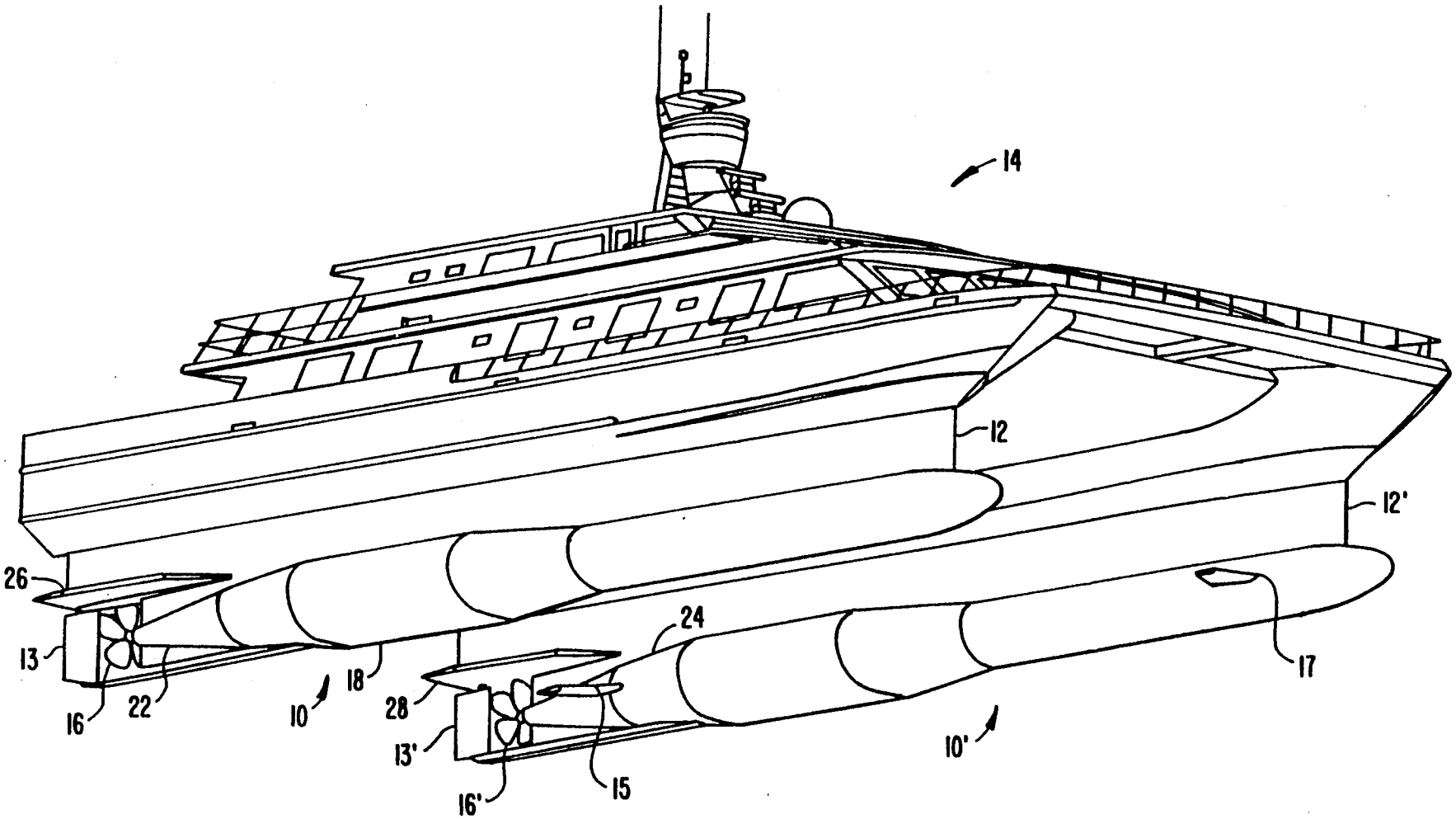
FIG. 1 is a perspective view illustrating a preferred arrangement of stern planes on a SWATH type vessel in accordance with the present invention.

Referring now to the drawings, the SWATH vessel embodying the stern plane of the present invention is shown in perspective in FIG. 1. As there shown the major components of the vessel are pontoons 10, 10' vertical supporting struts 12, 12 and an above-water superstructure indicated generally as 14.

The underwater pontoons 10, 10' and the immersed portions of the struts 12, 12' are, of course, watertight, and they provide sufficient flotation or buoyancy to maintain the superstructure 14 at some desired predetermined distance spaced above the water line when the vessel is at rest in the water. The pontoons 10, 10' extend substantially the full length of the vessel and, in the embodiment shown, serve to house the main propulsion engines (such as diesel engines), which can be operated by conventional state-of-the-art means to rotate either or both of the drive shafts and the propellers 16, 16' to propel and assist in steering the vessel. Associated with the pontoons 10, 10' are twin rudders 13, 13', and forward and aft horizontal stabilizers 15 and canards 17.

In the embodiment shown, the two pontoons 10, 10' are provided with enlarged aft bulges 18 and 20 respectively. Bulges 18, 20 are provided to more conveniently accommodate the main engine propulsion system with their associated parts. The bulged pontoons are considered to be of substantial benefit and value in relatively small boats (i.e., less than 100 feet) where the main engines cannot be conveniently fitted with sufficient work space for access into constant diameter pontoons, or when constant-diameter pontoons would provide excess buoyancy. Although it is highly desirable from a practical standpoint to mount the main drive engines in the pontoons to provide a lower center of gravity and more utility above the water deck for cabin or storage space, insofar as the scope of the present invention is concerned, it is immaterial whether the main engines are placed in the underwater pontoons or in another location above the pontoons, such as on the deck of the superstructure 14. In the latter case, the rearwardly located engines would drive the propeller shaft by conventional "Z" drive or other known mechanical linkage mechanism mounted within the struts 12, 12'.

In the embodiment of the invention shown in the drawings, each of the struts 12, 12' comprises a singe elongated vertical hydrodynamic strut extending substantially the full length of the vessel. The struts 12, 12' have many purposes and uses. For example, they may be used as access passages to the interior of the pontoons so that maintenance or other operations on the engines and equipment may be performed. More importantly, however, struts 12, 12' connect with and vertically support the entire superstructure 14 above the normal calm water line by a predetermined calculated distance and provide hydrostatic stability for the vessel.

The use of stern planes 26 with SWATH type vessels is particularly important because practical limits are imposed on the depth of the pontoons 10' below the surface by the water depths in harbors. Often, these draft limits cause the pontoons of the SWATH vessel to be so near to the water surface that when running at moderate to high speeds at level trim, reduced pressure occurs on the upper side of the pontoon tail cone and a depression is formed in the water surface above the propeller. The reduced pressure on the tail cone increases drag on the vessel and the water surface depression can cause the propeller to ventilate (ingest air), resulting in vibration and loss of propeller efficiency. In order to improve performance under these conditions, the vessel was heretofore trimmed down by the stern by adjusting the stabilizers for example, usually 2 or 3 degrees to alter the water flow pattern at the tail cone and move the propeller further below the water surface. Trimming the stern down decreases the clearance between the water surface and the upper platform, increasing the possibility of "slamming", and the resulting slant of the deck can be undesirable for some SWATH vessel applications. Depression of the water surface over the propeller can also be produced by downward deflection of the trailing edge of the aft stabilizer fin, usually located not far ahead of the propeller. To avoid propeller ventilation from this source, deflection of the stabilizer fin is usually restricted, causing a corresponding loss in its control effectiveness. The use of stern planes 26 reduces the necessity to trim down by the stern.

In accordance with the invention SWATH stern planes 26 improve the water flow over the upper side of the pontoon tail cone 22 and reduce the tendency towards propeller ventilation for shallow running pontoons. The effectiveness of the stern planes has been demonstrated in tow tank tests and on a small full scale test SWATH vessel. The tests have shown that the use of stern planes allows a SWATH vessel to run efficiently at level trim and without propeller ventilation.

The stern plane 26 is located just above the propeller 16, protruding laterally on either side of the strut 12, with its forward edge located near the forward end of the pontoon tail cone 22 and its trailing edge near the trailing edge of the strut 12. Preferably, the stern plane 26 can be an isolated appendage mounted on the strut 12. Alternatively, it can be integrated with the tail cone section 22 of the pontoon. The horizontal span of the stern plane is limited on the outboard side of the strut primarily by operational considerations, such as avoidance of contact with pilings during docking, whereas the horizontal span on the inboard side of the strut is much less restricted. Nevertheless, it is usually preferred to have the stern planes 26 formed symmetrically about the strut 12. The longitudinal cross section of the stern plane is generally airfoil shaped with a rounded leading edge and a fairly sharp wedge-shaped trailing edge with a constant thickness section in between. The stern plane 26 in accordance with the invention prevents the water flow above the top of the pontoon from following the contour of the tail cone 22 down toward the propeller 16 at high speeds and aids pressure recovery on the upper side of the tail cone to thus eliminate a depression being formed in the water. In addition to eliminating the depression of the water surface over the propeller, the stern plane 26 acts as an efficient pitch stabilization fin due to its extreme aft location on the vessel and provides additional damping of pitch and roll motions at all speeds.

Figure 2:
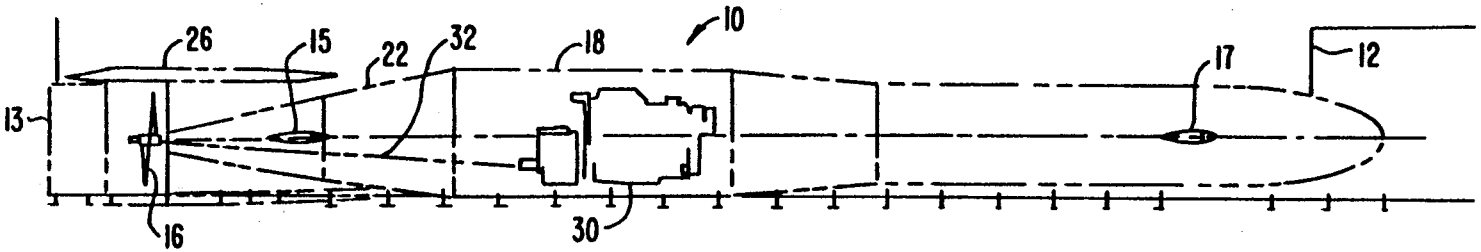
FIG. 2 is an elevation view, partially in phantom and with portions broken away for clarity of presentation, illustrating the below water line portion of the preferred embodiment of the present invention.

In FIG. 2, a typical pontoon 10, strut 12 and other elements of the present invention are shown in a below waterline view partially in phantom with parts removed for clarity of presentation. As there shown the pontoon 10 includes an enlarged portion 18 in which a suitable engine 30 is mounted. A drive shaft 32 is connected to the engine for rotating the propeller 16. The propeller is located aft of the streamlined tail cone section 22 which forms the rear portion of the pontoon. Also mounted on the pontoon are stabilizer fin 15 and canard fin 17. These fins are used to trim and stabilize the vessel. A rudder 13 is mounted aft of propeller 16 for use in steering the vessel.

In accordance with the preferred form of the invention a horizontally disposed stern plane 26 is connected to strut 12 below the waterline of the SWATH vessel immediately above the propeller 16. The stern plane also overlies at least a portion of the streamlined tail cone 22 and extends over the aft portion thereof. The stern plane 26 is configured and located with the respect to the propeller 16 and the streamlined tail cone 22 to influence water flow over the upper side of the cone when the vessel is in motion to substantially reduce the tendency of the water flow to follow down the tail cone and to thus cause a depression near the propeller which would result in propeller ventilation. Thus the stern plane is located to promote water flow over the topside of the stern plane to thus maintain adequate water depth over the propeller by inducing water flow from below.

The stern plane is preferably overlies about 50% or more of each tail cone. The stern plane can effectively extend from $\frac{1}{3}$ to $\frac{2}{3}$ over the tail cone 23. The stern plane also preferably extends beyond the aft end of the tail cone. It should also closely overlie the propeller 16. Adequate clearance from the propeller is needed to reduce vibration problems. In most cases the clearance should be at least about 1/10 of the diameter of the propeller 16. The stern planes for best stability and motion damping purposes should extend over the propeller and preferably to the end of the struts. The stern plane is located so as to induce water flow from below the propeller to fill the space between the upper portion of the propeller and the stern plane.

Figure 3:
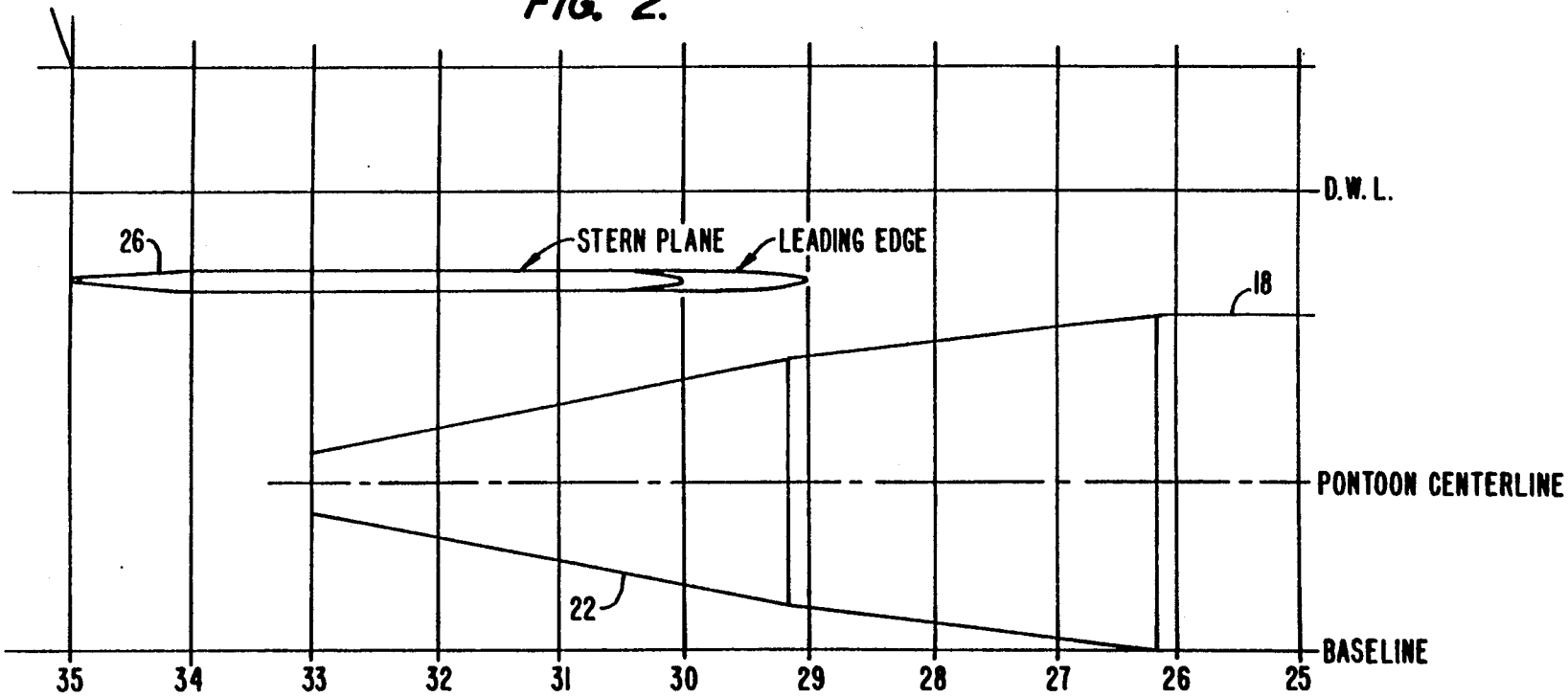
FIG. 3 is a profile view, partially in phantom and containing frame references, illustrating the preferred embodiment of the invention in more detail.
Figure 4:
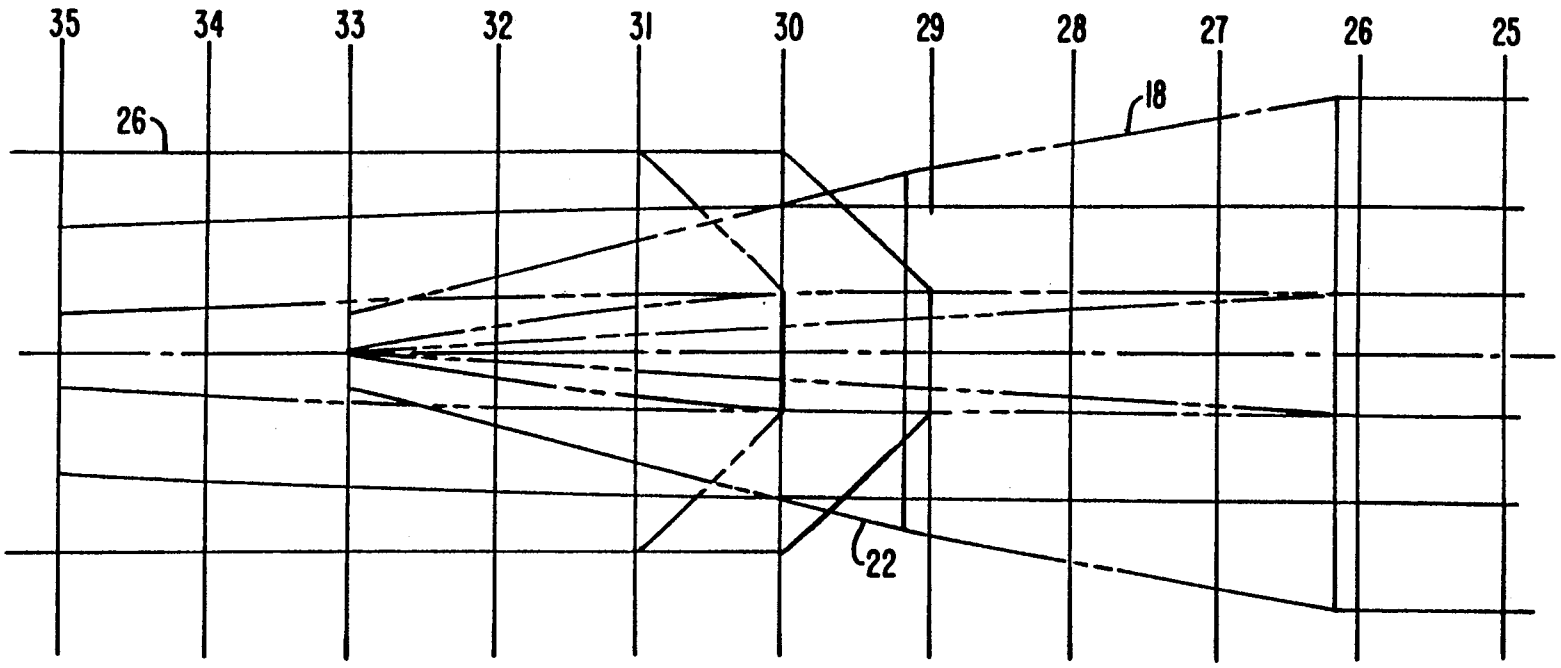
FIG. 4 is a phantom plan view containing frame references of the preferred embodiment of apparatus illustrated in FIG. 3.
Figure 5:
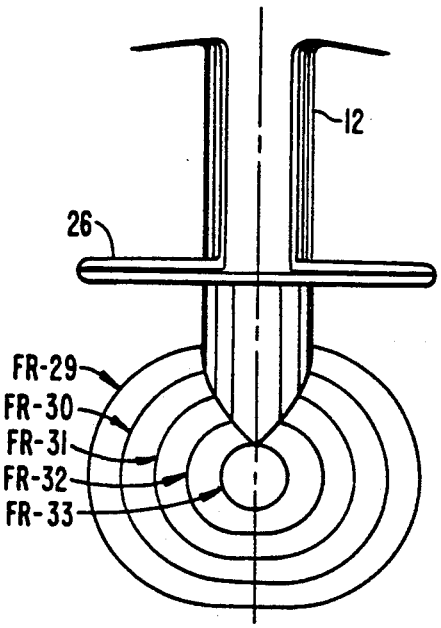
FIG. 5 is a body plan view of the preferred embodiment as illustrated in FIGS. 3 and 4.

FIGS. 3–5 are illustrations of the preferred stern plane configured in accordance with the present invention. FIG. 3 is a profile view partially in phantom and shows the location of the stern plane 26 with respect to the tail cone 22 of pontoon 18. The leading edge of the stern plane preferably is located at at least about the middle of the tail cone 22. Thus, the stern plane overlies the aft 50% of the tail cone. The stern plane is connected to the strut 12 as illustrated in FIG. 5 and the leading edge of the stern plane is disposed closely above the tail cone in a position to provide suitable water flow over the propeller. In the particular embodiment illustrated the leading edge of the stern plane is about one foot above the tail cone.

Figure 7:
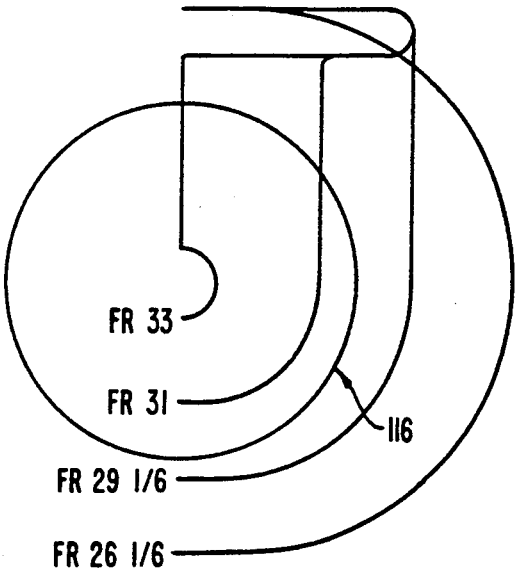
FIG. 7 is a partial phantom body plan of the alternative embodiment of the invention shown in FIG. 6 and illustrates the relationship of the propeller disk to the stern plane.
Figure 6:
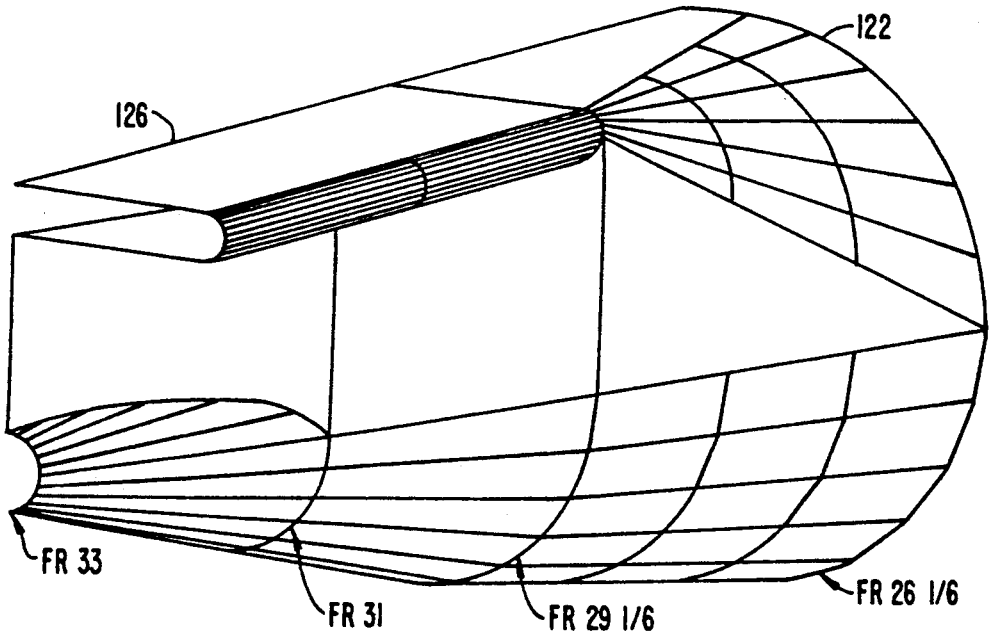
FIG. 6 is a partial phantom perspective view containing frame references and illustrates an alternative embodiment of apparatus assembled in accordance with the present invention.

FIG. 6 is a partial phantom perspective view containing frame references of an alternative embodiment of the present invention. FIG. 7 is a partial phantom body plan view of the alternative embodiment of the invention and shows some typical dimensions of a stern plane and its position with regard to the tail cone and propellers. In the alternative embodiment shown in FIGS. 6 and 7, the stern plane 126 is connected into the tail cone 122 at about midway of the tail cone structure. The FR references on the drawing indicate the distances in feet from the front to the aft of the pontoon. The FR references in the drawing indicate frame numbers referred to the front of the pontoon, the distance between frames being 3 feet. Thus FR33 is a representation of the tail cone 33 frames (99 feet) aft of the front of the pontoon. The propeller is located just aft of FR33. FIG. illustrates the location of the stern plane 126 with reference to the propeller disk which is indicated by the numeral 116. As there shown, the bottom of the stern plane is approximately nine inches from the tip of the propeller. In general, the clearance between the propeller tips and the stern plane should be at least 1/10 of the diameter of the propeller to provide adequate clearance to prevent vibration problems when the vessel is at motion. Preferably a portion of the stern plane also extends to a position overlying the propeller.

Figure 8:
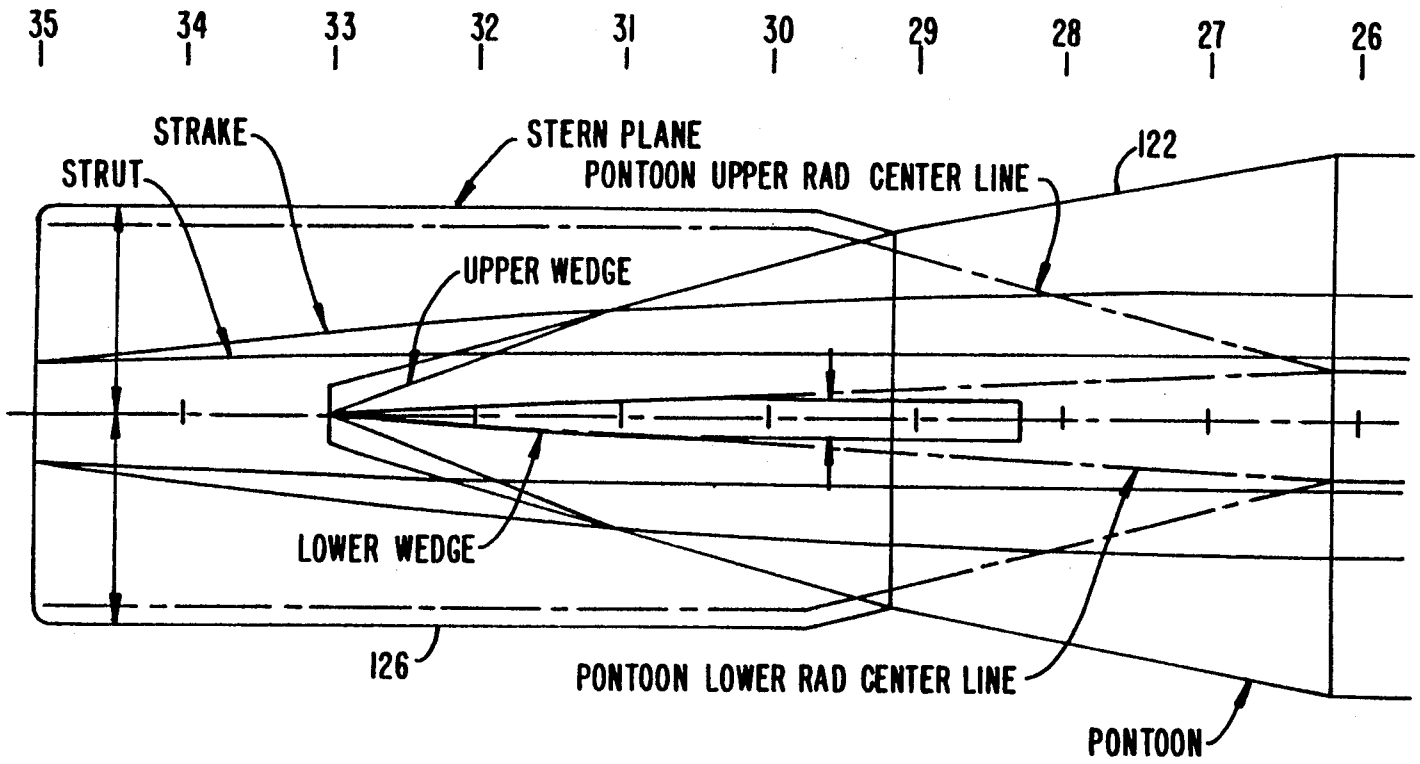
FIG. 8 is a phantom plan view containing frame references and shows the alternative embodiment of apparatus of the present invention.
Figure 9:
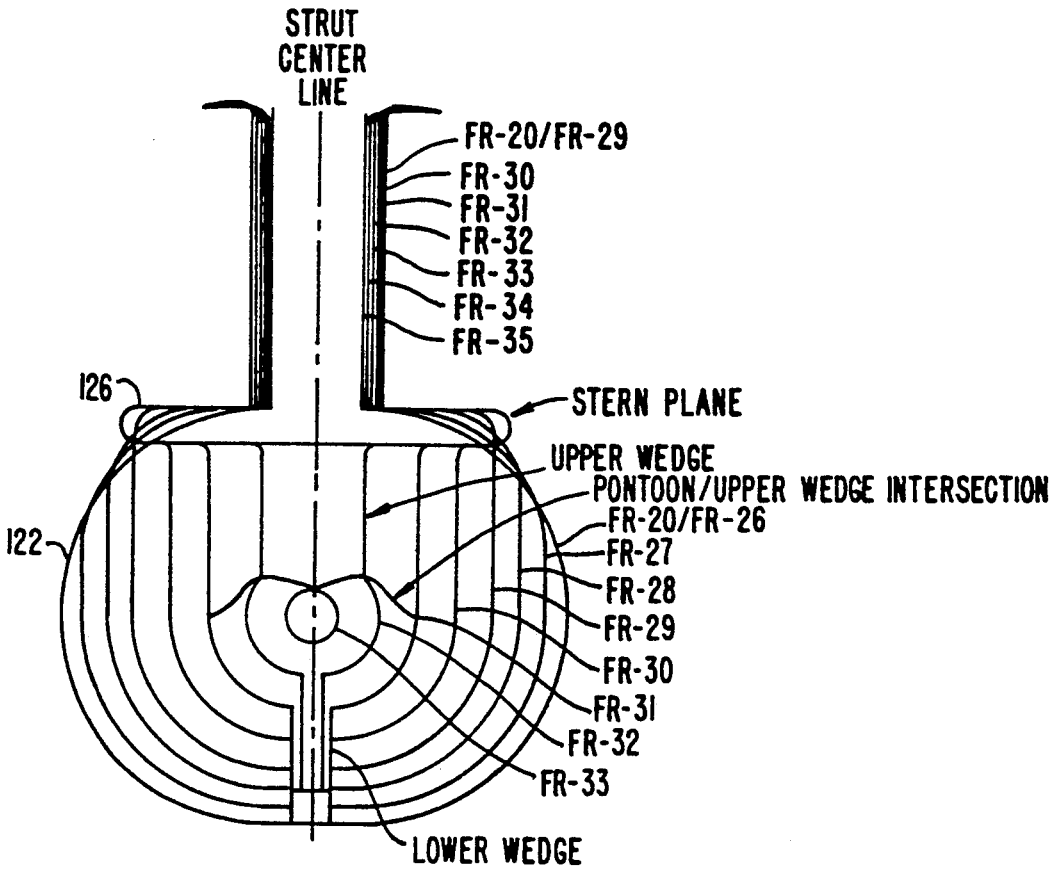
FIG. 9 is a phantom body section of FIG. 8 containing frame references illustrating the alternative embodiment of the invention.

FIG. 8 is a phantom plan view containing frame references and FIG. 9 is a body section of the alternative embodiment of the stern plane arrangement in accordance with the present invention. As these show, the stern plane 126 is connected into the tail cone 122 of the pontoon. The stern plane 126 overlies the aft portion of the tail cone and the propeller. It is preferred to have the stern plane extend to the end of the strut 112.

Figure 10:
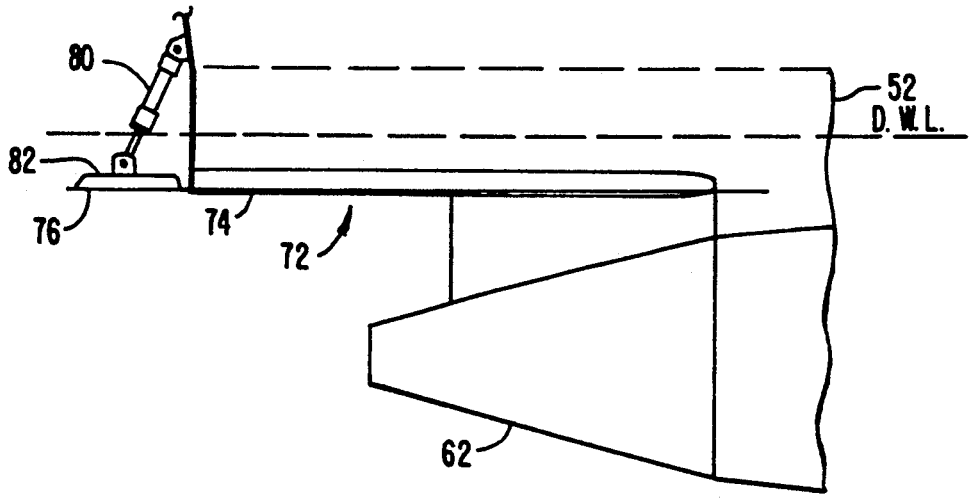
FIG. 10 is an enlarged plan view of the aft portion of a stern plane and illustrates the use of a flap therewith.
Figure 11:
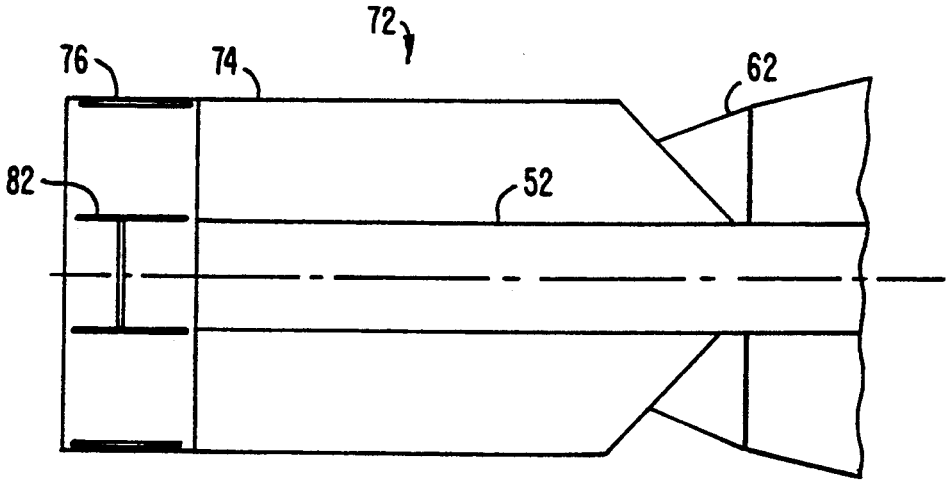
FIG. 11 is a elevation view of the stern plane illustrated in FIG. 10.

Referring to FIGS. 10 and 11, a stern plane indicated generally by the number 72 is shown in plan view. The stern plane 72 is connected to strut 52 immediately above the tail cone portion 62 of the pontoon. The stern plane 72 includes a forward horizontally disposed portion 74 which is fixedly mounted to the strut 52. A controllable flap 76 is connected by a suitable hinge 78 aft of the trim plate portion 74 of the stern plane 72. The flap 76 is adjusted to a desirable position by means of a hydraulic cylinder 80 which is operatively connected between the control tab arrangement 82 attached to the flap 76 and the tab 84 attached to the strut 52. The hydraulic cylinder may be remotely controlled to elevate or depress the flap as required to trim or assisting in controlling the vessel as needed.

Figure 12:
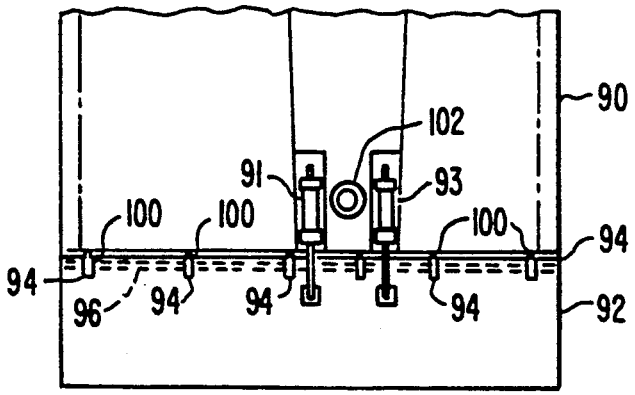
FIG. 12 is a plan view illustrating an alternative embodiment of a stern plane having a flap.

FIG. 12 is a plan view illustrating another control linkage useful to connect to control fin to the stern plane of the present invention. The stern plane 90 has a control flap 92 attached to it aft end by means of rearwardly extending brackets 94 which capture shaft 96 contained in a sleeve of the flap 94. A pair of hydraulic cylinders 91, 93 are connected between the flap 92 and the recesses 95, 97 in the strut 100. The hydraulic cylinders are connected to the strut on opposite sides of the rudder shaft 102 and may be remotely actuated to control the attitude of the flap.

The principles, preferred embodiments and modes or operation of the present invention have been described in the foregoing specification. However, the invention which is intended to be protected is not to be construed as limited to the particular embodiments disclosed. The embodiments are to be regarded as illustrative rather than restrictive. Variations and changes may be made by other without departing from the spirit of the present invention. Accordingly, all such variations and changes, which fall within the spirit and scope of the present invention as defined in the followed claims, are expressly intended to be embraced thereby.

What is claimed is:

1. A twin pontoon vessel comprising:

a superstructure;

first and second pontoons disposed beneath the superstructure, each of said first and second pontoons including a streamlined tail cone forming the aft portion of the said pontoons said streamlined tail cones being of smaller diameter than said pontoons;

at least one strut disposed between each pontoon and the superstructure for supporting the superstructure, so that the combined buoyancy of the first and second pontoons and the struts is sufficient to support the superstructure spaced above the waterline by a prescribed distance when the vessel is at rest in calm water;

propellers located aft of each streamlined tail cone of each of said first and second pontoons;

engine means in said vessel for driving said propellers;

drive shaft means operatively connected to said engine means extending out of the aft portion of each of said streamlined tail cones of each said pontoons and connected to each propeller; and horizontally disposed stern planes connected to the vessel immediately above each propeller and overlying between ⅓ to ⅔ of the aft portion of the streamline tail cone of each of said pontoons and below the design waterline of said vessel, each of said stern planes configured and located with respect to each propeller and each streamlined cone to influence water flow over the upper side of each of the streamlined tail cones to substantially reduce the tendency toward water flow which otherwise would cause propeller ventilation when the vessel is moving.

2. The vessel of claim 1 further characterized in that the stern planes are connected to said struts.

3. The vessel of claim 1 further characterized in that the stern planes are connected to the tail cones of the pontoons.

4. The vessel of claim 1 further characterized in that the stern planes overlie the propeller connected at the aft portion of the pontoons.

5. The vessel of claim 1 further characterized in that the stern planes includes control flaps at the aft ends and said control flaps can be elevated or depressed to assist in controlling the vessel.

6. The vessel of claim 1 further characterized in that the stern plane overlies the propeller connected at the aft portion of the pontoon by a distance of at least 1/10 of the diameter of the propeller.

7. The vessel of claim 2 further characterized in that the stern planes overlie the propellers connected at the aft portion of the pontoons.

8. The vessel of claim 2 further characterized in that the stern planes includes control flaps at the aft ends and said control flaps can be elevated or depressed to assist in controlling the vessel.

9. The vessel of claim 3 further characterized in that the stern planes overlie the propellers connected at the aft portion of the pontoons.

10. The vessel of claim 9 where the distance between the stern planes and the propellers is at least 1/10 of the diameter of the propellers.

11. The vessel of claim 3 further characterized in that the stern planes includes control flaps at the aft ends and said control flaps can be elevated or depressed to assist in controlling the vessel.

12. In a vessel having at least two submerged parallel pontoons, at least one vertical strut extending upwardly from each pontoon cooperatively supporting a superstructure above the water line, the combined buoyancy of the two pontoons and the struts being such as to support the superstructure above the water line while the vessel is at rest, the two pontoons each having a rearwardly tapering streamlined tail cones of substantially less diameter than the pontoons and a propeller located aft of each of said tail cones and drive shafts operably connecting each propeller with engine means located in the vessel the improvement comprising stern plane means fixedly connected to said vessel and disposed in a substantially horizontal plane above said propellers and extending over from $\frac{1}{3}$ to $\frac{2}{3}$ of the aft portion of said tail cones to reduce depression of the water in the vicinity of said propellers and thus inhibit ventilation of the propellers when the vessel is moving in the water.

13. The vessel of claim 12 further characterized in that a stern plane is connected to each strut disposed between each pontoon and the superstructure of the vessel.

14. The vessel of claim 12 further characterized in that a stern plane is connected to each of the tail cones of the pontoons.

15. The vessel of claim 12 further characterized in that the stern plane overlies the propeller connected at the aft portion of the pontoon by a distance of at least 1/10 of the diameter of the propeller.

16. The vessel of claim 12 further characterized in that the stern plane includes a control flap at its aft end and said control flap can be elevated or depressed to assist in controlling the vessel.

17. The vessel of claim 12 further characterized in that the stern plane overlies the propeller connected at the aft portion of the pontoon by a distance at least 1/10 of the diameter of the propeller.

* * * * *